US007401782B2

(12) United States Patent
Dragotta et al.

(10) Patent No.: US 7,401,782 B2
(45) Date of Patent: Jul. 22, 2008

(54) CARD HOLDER AND MARKING GUIDE

(76) Inventors: Anthony Dragotta, 110 Gatchel St., Buffalo, NY (US) 14212; Joel Liberman, 3803 Noatrand Ave., Apartment 1J, Brooklyn, NY (US) 11235

( * ) Notice: Subject to any disclaimer, the term of this patent is extended or adjusted under 35 U.S.C. 154(b) by 149 days.

(21) Appl. No.: 11/302,553

(22) Filed: Dec. 13, 2005

(65) Prior Publication Data

US 2006/0125183 A1 Jun. 15, 2006

Related U.S. Application Data

(60) Provisional application No. 60/635,585, filed on Dec. 13, 2004.

(51) Int. Cl.
*A63F 3/06* (2006.01)

(52) U.S. Cl. ..... 273/148 R; 273/138.1

(58) Field of Classification Search ..... 273/148 R, 273/138.1, 148 RR

See application file for complete search history.

(56) References Cited

U.S. PATENT DOCUMENTS

| | | | | | |
|---|---|---|---|---|---|
| 4,586,906 | A | * | 5/1986 | Buccieri, Jr. | 273/148 R |
| 4,781,379 | A | | 11/1988 | Parks | |
| 4,852,268 | A | * | 8/1989 | Sutherland et al. | 33/562 |
| 5,080,223 | A | | 1/1992 | Mitsuyama | |
| 5,158,294 | A | * | 10/1992 | Piro | 273/148 R |
| 5,482,509 | A | | 1/1996 | Dull | |
| D383,502 | S | * | 9/1997 | Schmidt et al. | D21/396 |
| 5,974,715 | A | * | 11/1999 | Werner et al. | 40/772 |

FOREIGN PATENT DOCUMENTS

| | | | | |
|---|---|---|---|---|
| CA | 2190663 | A | * | 5/1998 |
| DE | 2458611 | A | * | 6/1976 |
| DE | 2611381 | A | * | 9/1977 |
| DE | 2914712 | A | * | 10/1980 |
| DE | 2917421 | A | * | 11/1980 |
| DE | 3011529 | A | * | 10/1981 |
| DE | 3235783 | A1 | * | 3/1984 |
| DE | 3245538 | A1 | * | 6/1984 |
| FR | 2561116 | A | * | 9/1985 |

* cited by examiner

*Primary Examiner*—Benjamin H Layno
(74) *Attorney, Agent, or Firm*—Kloss, Stenger & LoTempio; Vincent G. LoTempio

(57) ABSTRACT

A lottery card holder and marking guide comprising a rectangular opaque base sheet and a transparent outer sheet aligned therewith, and joined with the base sheet along at least one edge thereof, the transparent outer sheet and base sheet being configured to hold a lottery card therebetween; the lottery card having imprinted thereon a multiplicity of wager sections, each wager section having imprinted therein a multiplicity of boxes arranged in rows and columns; the transparent outer sheet having a multiplicity of open slots arranged in rows and columns configured in the same pattern as the multiplicity of boxes in the wager sections so that when the lottery card is positioned in the holder and marking guide, each of said slots will be aligned with a corresponding box on the lottery card.

2 Claims, 2 Drawing Sheets

CARD HOLDER AND MARKING GUIDE

This application claims priority of U.S. Provisional Patent Application 60/635,585 filed on Dec. 13, 2004, titled CARD HOLDER AND MARKING GUIDE.

BACKGROUND OF THE INVENTION

The present invention relates to a lottery ticket holder and marking guide configured to protectively hold and accurately select particular numbers on any lottery card.

Numerous states in the United States operate lotteries as a way of raising money. Many of these lotteries use a card printed with groups of numbers, each group constituting a separate game of chance. A person may purchase any or all of the games on a card. A person plays the games by marking or blackening the numbers on the card. A computer then reads the card and returns it to the player. Typically game players have favorite numbers and the cards are used over and over. One problem encountered in the use of the lottery game cards is that the cards are difficult preserve between uses because the cards are characteristically made of a paper product that can easily be wrinkled or folded. When a card is wrinkled or folded it is rendered unreadable and a new card has to be filled out. Filling out a new card can be difficult and time consuming for anyone, especially for people with poor eyesight.

A problem that often occurs when a person is filling out a lottery card is that the card is inaccurately completed when a person blackens the wrong number because of poor memory or poor eyesight. Lottery cards have many small numbers that are difficult to see. It is also necessary to remember multiple numbers to play a typical lottery game. The present invention provides a lotto player a convenient protective holder and guide for marking a lottery card and eliminates the nuisance of having to remember what numbers to play.

Various types of lottery card holders have been invented to help a person preserve their lottery card. Some of these devices require ungainly attachments and clips. Others are suitable for reading the cards of only one type of game, or the cards from only one state, and cannot be used for cards of other states or other types of games. Many prior attempts have been made to alleviate the problems associated with lottery card holders.

For example, U.S. Pat. No. 5,482,509 (Dull) discloses a lottery play slip and lottery card jacket for protectively holding one or a plurality of play slips or lottery tickets. This invention is comprised of a transparent panel that protectively encloses and holds lottery tickets. This invention does not overcome the problem of being able to accurately fill in the spaces of the card while it is enclosed in the ticket jacket. There is no suggestion to teach a ticket or card holder with a cover having slots that lineup with the numbers of a lottery card used as a guide to fill out the lottery card.

U.S. Pat. No. 4,781,379 (Parks) teaches the use of a single fold wallet for storing lottery tickets, and for readily identifying winning numbers on each ticket, having flat sides provided with transparent faced pockets, a swingable flat member having a rectangular transparent window for overlying lotto tickets, and a marking pen carried in a loop of flexible material at the fold line of the wallet and formed for marking rings on the transparent window to indicate the location of winning numbers in each of the numbered unit areas of lotto tickets. However this patent also suffers in that it does not act as guide for marking a lottery card. It is limited in use to merely holding lottery cards.

Another lottery card holding instrument is disclosed by U.S. Pat. No. 5,080,223 (Mitsuyama). This patent relates to a card case, made of two rectangular sheets of plastic or leather, produced by fusing or seaming three edges thereof together and leaving one edge thereof unfused. One or both of the rectangular sheets are provided with an elongated opening the width of which is at least sufficient to receive a fingertip so as to allow a card to be pushed through the open side. The Mitsuyama patent does teach a slip jacket or container for protectively holding cards and allowing cards to be easily dispensed; however this patent fails to allow for accurately filling in the spaces corresponding to the number markings with a pen or pencil on a Lotto card. In addition its three sided connection is ungainly and in practice doesn't work. The cards can not be easily inserted or removed.

Thus it is readily apparent that there is a longfelt need for a convenient holder and guide for marking a lottery card which acts as a marking guide for filling out a lottery card and eliminates the nuisance of remembering numbers and provides a convenient protective holder that stores and preserves the lottery card between uses.

SUMMARY OF THE INVENTION

The present invention is a device which protectively holds a lottery card and allows easy and accurate marking of the card. The lottery ticket holder and marking guide is comprised of a rectangular opaque base sheet and a transparent outer sheet aligned therewith, and joined with the base sheet along at least one edge thereof, the transparent outer sheet and base sheet being configured to hold a lottery ticket therebetween; the lottery ticket having imprinted thereon a multiplicity of wager sections, each wager section having imprinted therein a multiplicity of boxes arranged in rows and columns; the transparent outer sheet having a multiplicity of open slots arranged in rows and columns configured in the same pattern as the multiplicity of boxes in the wager sections so that when the lottery ticket is positioned in the holder and marking guide, each of said slots will be aligned with a corresponding box on the lottery ticket.

It is a general object of the present invention to provide lottery card holder and marking guide which will protectively enclose and hold one or a plurality of lottery play slips and lottery tickets.

Another object of the present invention is to provide a lottery card holder and marking guide which is transparent and has a multiplicity of open slots arranged in rows and columns for easy marking numbers contained on a lottery card.

Yet another object of the present invention is to provide a lottery card holder and marking guide which is inexpensive to manufacture and is easily carryable in a purse or pocket of the lottery participant.

Still another object of the present invention is to provide a lottery card holder and marking guide whose sheet components may be separable for ease in removing and inserting quantities of both lottery play cards and lottery tickets.

A further object of the present invention is to provide a method for marking lottery game cards and remembering numbers which is relatively simple in operation.

A further object of the present invention is to provide a method for marking game tickets which insures against inadvertent marking errors.

Still another object of the present invention is to provide a lottery card holder and marking guide that can be used with any lottery card.

These and other objects, features, and advantages of the present invention will become apparent upon a reading of the detailed description and claims in view of the several drawing figures.

DETAILED DESCRIPTION OF THE PREFERRED EMBODIMENT

Figure 1:
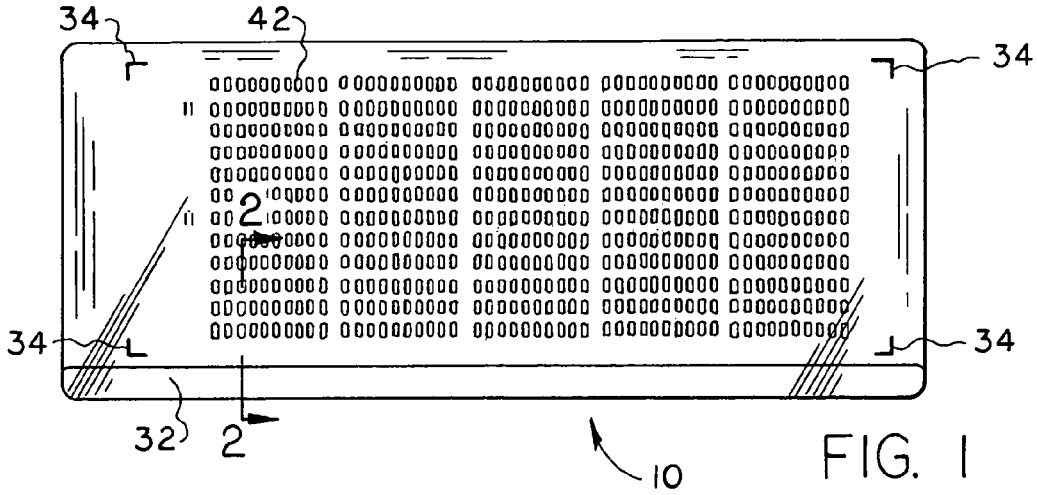
FIG. 1 is a plan view of a preferred embodiment of the present invention.

This application claims priority of U.S. Provisional Patent Application 60/635,585 filed on Dec. 13, 2004, titled CARD HOLDER AND MARKING GUIDE.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Numerous states in the United States operate lotteries as a way of raising money. Many of these lotteries use a card printed with groups of numbers, each group constituting a separate game of chance. A person may purchase any or all of the games on a card. He plays the games by marking his choice of numbers in each game he bought. A machine then reads the card and returns it to the player. Typically game players have favorite numbers that are played over and over. The cards are characteristically made of a paper product that can easily be wrinkled or folded. When a card is wrinkled or folded it is rendered unreadable and a new card has to be filled out. The instant invention acts as a protective holder which keeps the card from becoming wrinkled or folded and increases the number of times a particular lottery card can be used. The numbers on the lottery card are typically very small and surrounded by a small oval or rectangular box. To select the number the box must be blackened by a pen or pencil. A person with poor eyesight and a poor memory usually has difficulty filling out a new lottery card. The present invention is a device for holding and/or displaying a lottery card, and is configured as a markable guide for marking particular numbers. The present invention provides a lotto player a convenient guide for marking a lottery card and eliminates the nuisance of remembering numbers and provides a convenient protective holder that stores and preserves the lottery card between uses.

Adverting now to the drawings, FIG. 1 is a perspective view of lottery card holder and marking guide 10 comprising base sheet 30 and outer sheet 40 aligned therewith. The base sheet is opaque and rectangularly shaped and joined along at least one edge (in this case edge 32) to outer sheet 40. The outer sheet is preferably transparent and operatively arranged to hold lottery card 20 therebetween. The transparent outer sheet is configured to protectively hold the lottery card in place and allow easy viewing of the lottery card.

Figure 2:
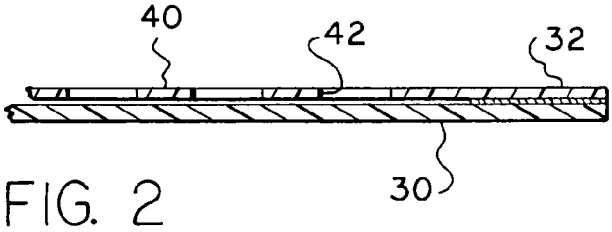
FIG. 2 is a cross-sectional view, taken generally along line 2-2 in FIG. 1.

FIG. 2 is a cross-sectional view of the preferred embodiment of the present invention, taken generally along line 2-2 in FIG. 1 of lottery card holder and marking guide 10 illustrating base sheet 30 joined along at least one edge (in this case edge 32) to outer sheet 40. The sheets thus joined form a card holder that is arranged to hold a lottery card therebetween. It must be understood that the connection of the sheets at edge 32 as shown in FIG. 2 is for illustration purposes only and it should be readily apparent to those of ordinary skill in the art that the sheets which comprise lottery card holder and marking guide 10 could be joined at any edge so long as there is space between the sheets to hold a lottery card. The connection of the sheets at edge 32 can be accomplished by any means well known in the art to affix sheets together, such as an adhesive, a clip, a folded edge or a pressure seal.

Figure 3:
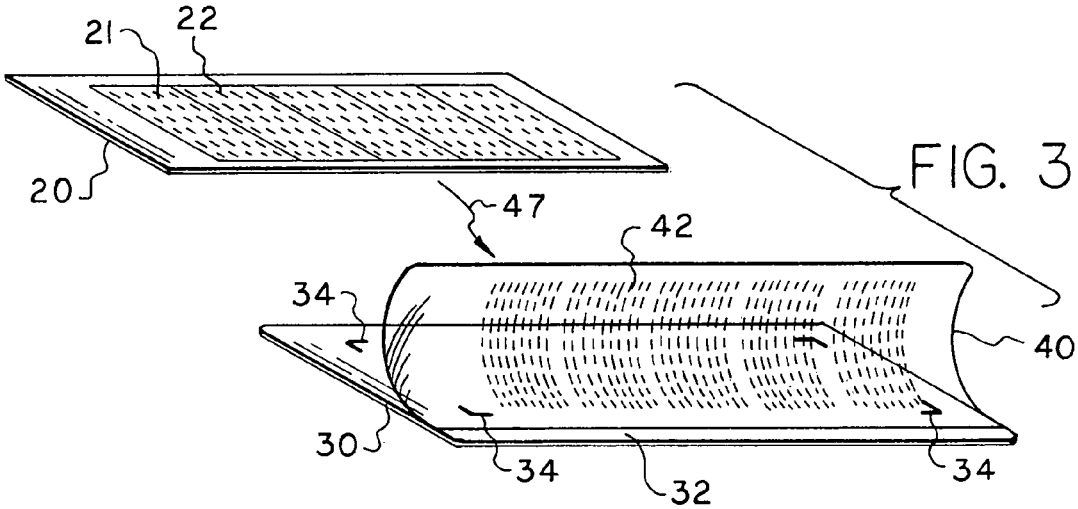
FIG. 3 is a perspective view of the present invention with a lottery ticket shown just before insertion therein.

FIG. 3 is a perspective view of the present invention with a lottery ticket shown just before insertion therein. In operation lottery card 20 is inserted between outer sheet 40 and base sheet 30 generally in the direction of Arrow 47. A typical lottery card has imprinted thereon a multiplicity of wager sections 21, each wager section having imprinted thereon a multiplicity of boxes 22 arranged in rows and columns. The transparent outer sheet having a multiplicity of open slots 42 arranged in rows and columns configured in the same pattern as the multiplicity of boxes in the wager sections so that when the lotto card is positioned in the holder and marking guide, each of the slots will be aligned with a corresponding box on the lottery card. Lottery tickets are of a conventional construction in many states and the instant figure is for illustrative purposes and this embodiment is one of many possible embodiments. It is contemplated as part of the present invention that to accommodate various states having different lottery game cards there could be more or less wager sections than shown in the figures referred to herein.

Figure 4:
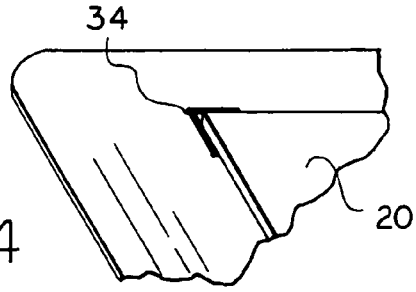
FIG. 4 is a partial cross-sectional view of a preferred embodiment of the present invention.

FIG. 4 is a partial cross-sectional view of a preferred embodiment of the present invention. Once the lottery card is placed between the transparent outer sheet, having a multiplicity of open slots 42 arranged in rows and columns configured in the same pattern as the multiplicity of boxes in the wager sections on the lottery card, the lotto card is aligned in the holder using marking guide 34. A properly aligned card positions each of the slots above a corresponding box on the lottery card.

Figure 5:
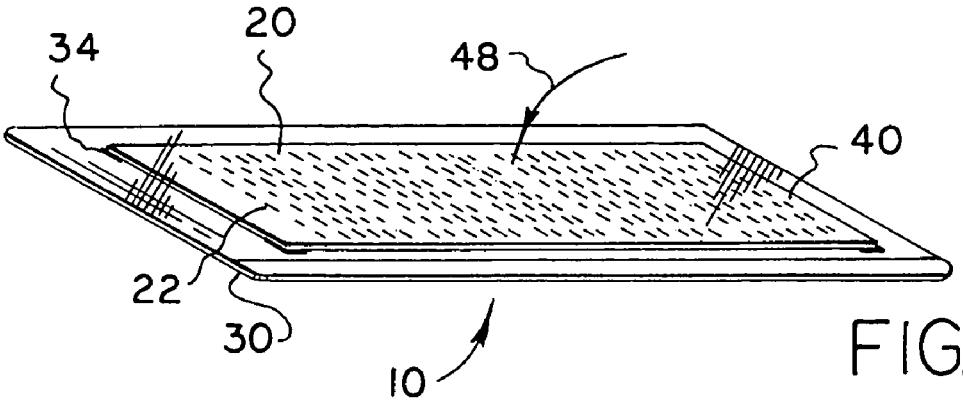
FIG. 5 is a perspective view of the present invention with a lottery ticket inserted therein.

FIG. 5 is a perspective view of the present invention with a lottery ticket inserted therein. Lottery card 20 is enclosed between outer sheet 40 and base sheet 30. Outer sheet 40 is moved generally in the direction of arrow 48 to enclose lottery card 20 within the instant invention. In a preferred embodiment, lottery card holder and marking guide 10 is made of plastic film, although any other material suitable to support and hold a lottery card, or the like can also be used, such as polyester film, synthetic film, PVC, vinyl, paper or cardboard. Base sheet 30 is formed from a sheet of opaque flexible film that acts as a writing support for a lottery card and outer sheet 40 is arranged to cover all or part of the lottery card. When the card is held between sheets comprised of a polymer such as plastic the surface energy of the plastic film holds a static electric bond that maintains the lottery card within the two sheets even though only one side of the holder is joined. This one-sided connection is easier to manufacture and more efficient than a three sided sealed pouch. The underlying lottery ticket is observable through the clear outer sheet which is arranged with slots that correspond to numbers on the lottery card. Each sheet is either transparent or translucent and the outer sheet has punched holes or slots that around which may be marked with the erasable lines, grids, or remain unmarked. The base sheet may be marked with lines, grids, advertisements or remain unmarked.

Figure 6:
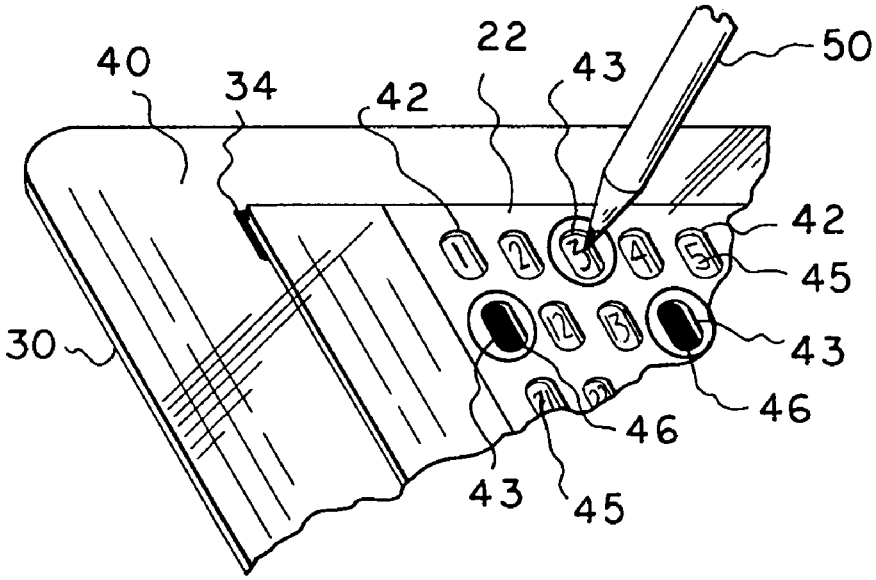
FIG. 6 is an enlarged partial cross-sectional view of a preferred embodiment of the present invention with a lottery ticket inserted therein.

FIG. 6 is an enlarged partial cross-sectional view of another preferred embodiment of the present invention with a lottery ticket inserted therein. The present invention is primarily directed to a marking guide for lottery tickets. It is sometimes difficult for people with poor vision to see the numbers on the card. The face of the transparent sheet of this preferred embodiment of the instant invention is configured to be marked by an erasable or indelible marker or crayon (not shown). FIG. 6 illustrates how the slots of outer sheet 40 can be configured with a marking crayon (see marked slots 43). Once lottery card 20 is properly aligned using alignment marks 34 on base sheet 30, the open slots are positioned above the numbers on the lottery card. The desired number is blacked out by simply inserting the tip of pencil 50 into the pre-circled or marked slot 43. FIG. 6 further illustrates blackened numbers 46 surrounded by marked slots 43 and unblackened numbers 45 surrounded by unmarked slots 42. By properly aligning the card with alignment marks 34 and premarking the desired slots a person can fill out a lottery card without remembering the number or having the ability to see the number on the lottery card.

Thus, it is seen that the objects of the invention are efficiently obtained. It will be understood that the foregoing description is illustrative of the invention and should not be considered as limiting and that other embodiments of the invention are possible without departing from the invention's spirit and scope.

What is claimed is:

1. A lottery card holder and marking guide comprising a rectangular base sheet having imprinted thereon a multiplicity of wager sections, each said wager section having imprinted therein a multiplicity of boxes arranged in rows and columns and a transparent outer sheet aligned therewith having a multiplicity of open slots arranged in rows and columns configured in the same pattern as said multiplicity of boxes in said wager sections so that when said lottery card is positioned in said holder and marking guide, each of said slots will be aligned with a corresponding box on said lottery card; wherein said transparent outer sheet is configured to be marked by an erasable or indelible marker or crayon, and joined with said base sheet along at least one edge thereof, said transparent outer sheet and base sheet being configured to hold a lottery card therebetween and wherein said base sheet and said transparent outer sheet are comprised of a polymer having a surface energy that holds a static electric bond that maintains said lottery card within said sheets.

2. A lottery card holder and marking guide according to claim 1 wherein said rectangular base sheet is transparent.

* * * * *